US005278738A

United States Patent [19]

Illes

[11] Patent Number: 5,278,738

[45] Date of Patent: Jan. 11, 1994

[54] IMPERIAL WALL SCONCE

[75] Inventor: Glenn M. Illes, Tustin, Calif.

[73] Assignee: Lam Lighting Systems, Inc., Wakefield, Mass.

[21] Appl. No.: 10,437

[22] Filed: Jan. 28, 1993

[51] Int. Cl.[5] ..... F21V 7/00

[52] U.S. Cl. ..... 362/147; 362/247; 362/307; 362/347

[58] Field of Search ..... 362/147, 247, 307, 347

[56] References Cited

U.S. PATENT DOCUMENTS 4,974,137 11/1990 Evans et al. ..... 362/147

*Primary Examiner*—Carroll B. Dority

*Attorney, Agent, or Firm*—Fitzpatrick, Cella, Harper & Scinto

[57] ABSTRACT

A wall light fixture is disclosed which includes a hollow generally translucent bowl. The bowl has an upwardly opening recess formed therein and a reflector is mounted in the bowl within the recess. The reflector has a predetermined light reflective pattern in order to reflect light from a source contained within the reflector to reflect light upwardly relative to the frame and laterally to at least a portion of the transparent bowl so that the bowl reflects light within it to provide an entirely luminous surface on the bowl.

14 Claims, 3 Drawing Sheets

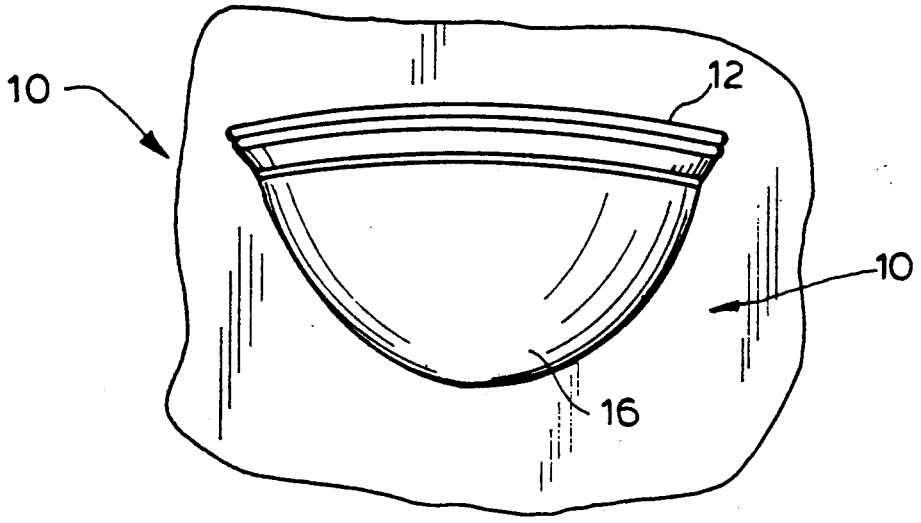
FIG. 1
FIG. 4
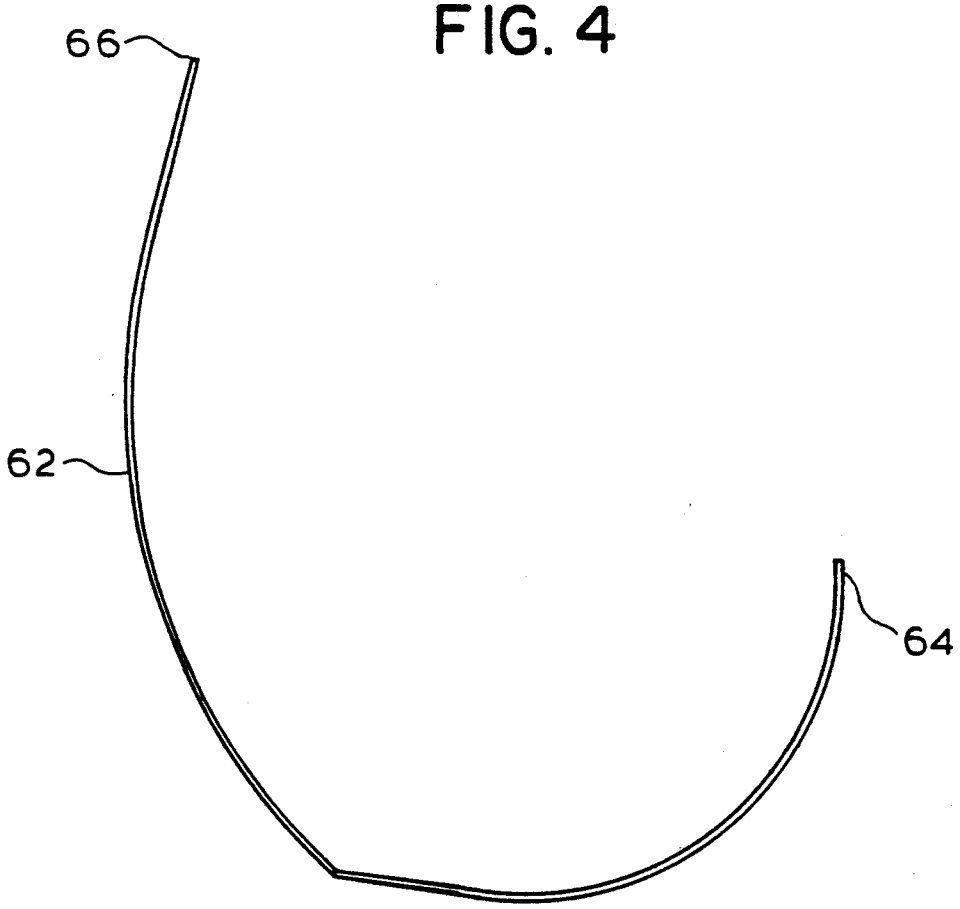

IMPERIAL WALL SCONCE

The present invention relates to wall fixtures and more in particular to a wall fixture which will provide both indirect and accent lighting.

Wall lighting fixtures or sconces have been provided in the past which create a variety of different lighting effects. One particularly popular effect is a light fixture which produces upwardly directed indirect lighting while also providing a luminous surface directed outwardly and downwardly to produce accent lighting. In such fixtures the majority of the light is the indirect lighting directed upwardly and/or towards the wall and ceiling produced from a single light source. A secondary fluorescent light source located, for example, on the opposite side of an individual reflector from the principal light source provides illumination for a surrounding translucent bowl or decorative housing to produce the desired accent lighting. Such lighting fixtures have proven to be highly popular for both their functional and aesthetic features. However, because such fixtures require two light sources, they are relatively expensive to manufacture and to maintain.

It is an object of the present invention to provide a wall lighting fixture or sconce which will produce both indirect and accent lighting from a single light source.

Another object of the present invention is to provide a wall sconce that includes a unique reflector and bowl construction which permits a single light source to produce both indirect and accent lighting.

Another object of the present invention is to provide a light fixture which is relatively simple to manufacture and inexpensive to construct.

Another object of the present invention is to provide a wall sconce which produces both indirect and accent lighting which is relatively inexpensive to manufacture while retaining the appearance of an expensive wall fixture.

In accordance with an aspect of the present invention, a wall lighting fixture or sconce is provided which includes a wall mounting plate and a hollow translucent bowl. The bowl has a recess formed therein below its upper edge portion and a light reflective element is mounted in the fixture within that recess. A light source, such as a fluorescent or high intensity halogen bulb, is supported within the reflector in a predetermined position. The reflector has a predetermined generally arcuate shape selected to reflect a majority of the light from the light source upwardly above the bowl and a portion of the light from the light source laterally above one of the edges of the reflector to a portion of the hollow bowl which surrounds the reflector. This light is received by the bowl and reflected repeatedly through its interior surfaces in order to illuminate the entire bowl and produce accent lighting.

The above and other objects, features and advantages of this invention will be apparent in the following detailed description of an illustrative embodiment thereof, which is to be read in connection with the accompanying drawings wherein:

FIG. 1 is a perspective view of a wall sconce fixture constructed in accordance with the present invention;

FIG. 4 is an enlarged detailed view, in cross-section, of the reflector element used in the device of the present invention.

Figure 2:
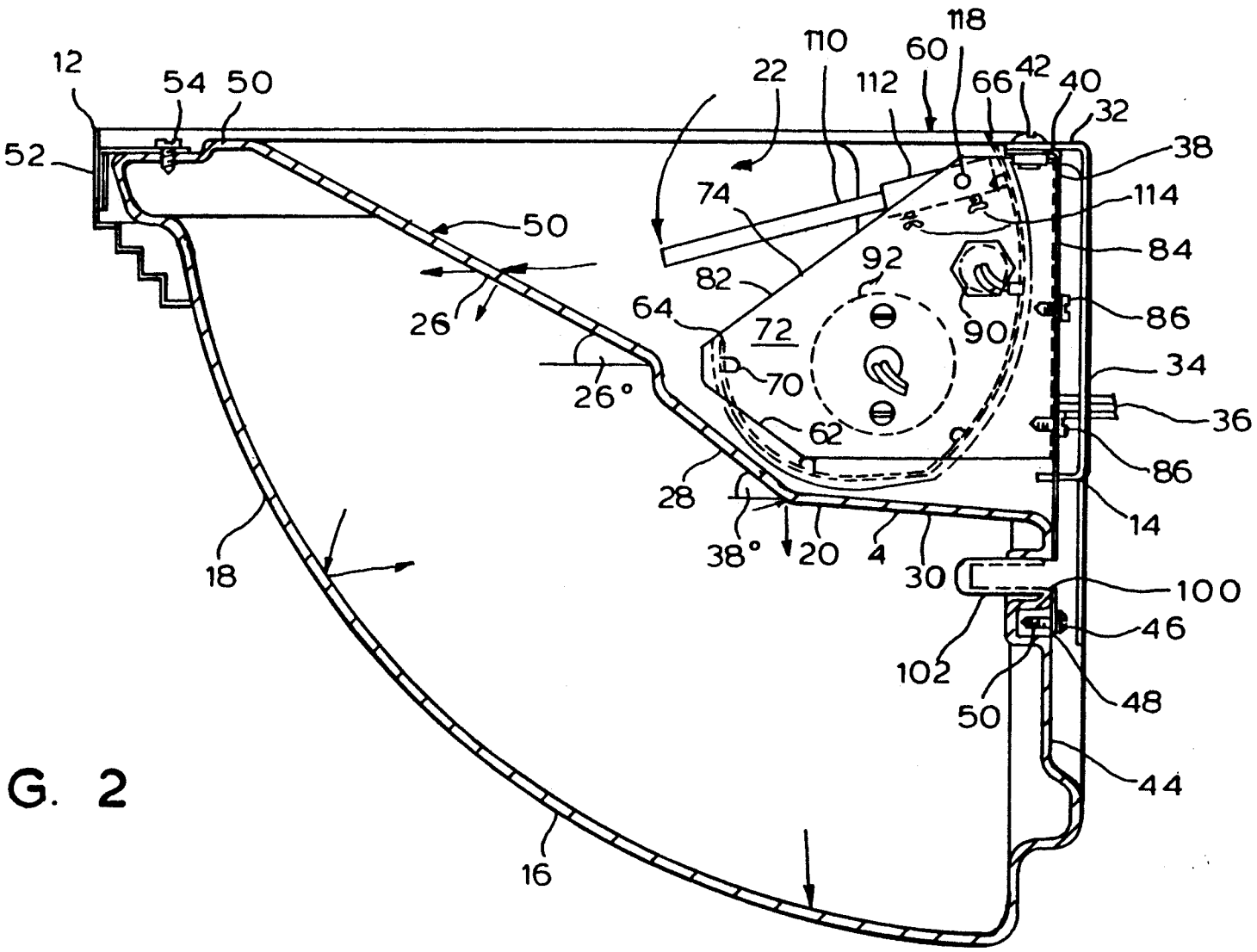
FIG. 2 is a sectional view taken along line 2—2 of FIG. 3.

Referring now to the drawings in detail, and initially to FIG. 1, a wall sconce 10 constructed in accordance with the present invention is illustrated. The sconce includes a peripheral trim ring 12, a wall mounting plate 14, and a translucent bowl element 16 which provides the accent lighting in the fixture as described hereinafter.

Figure 3:
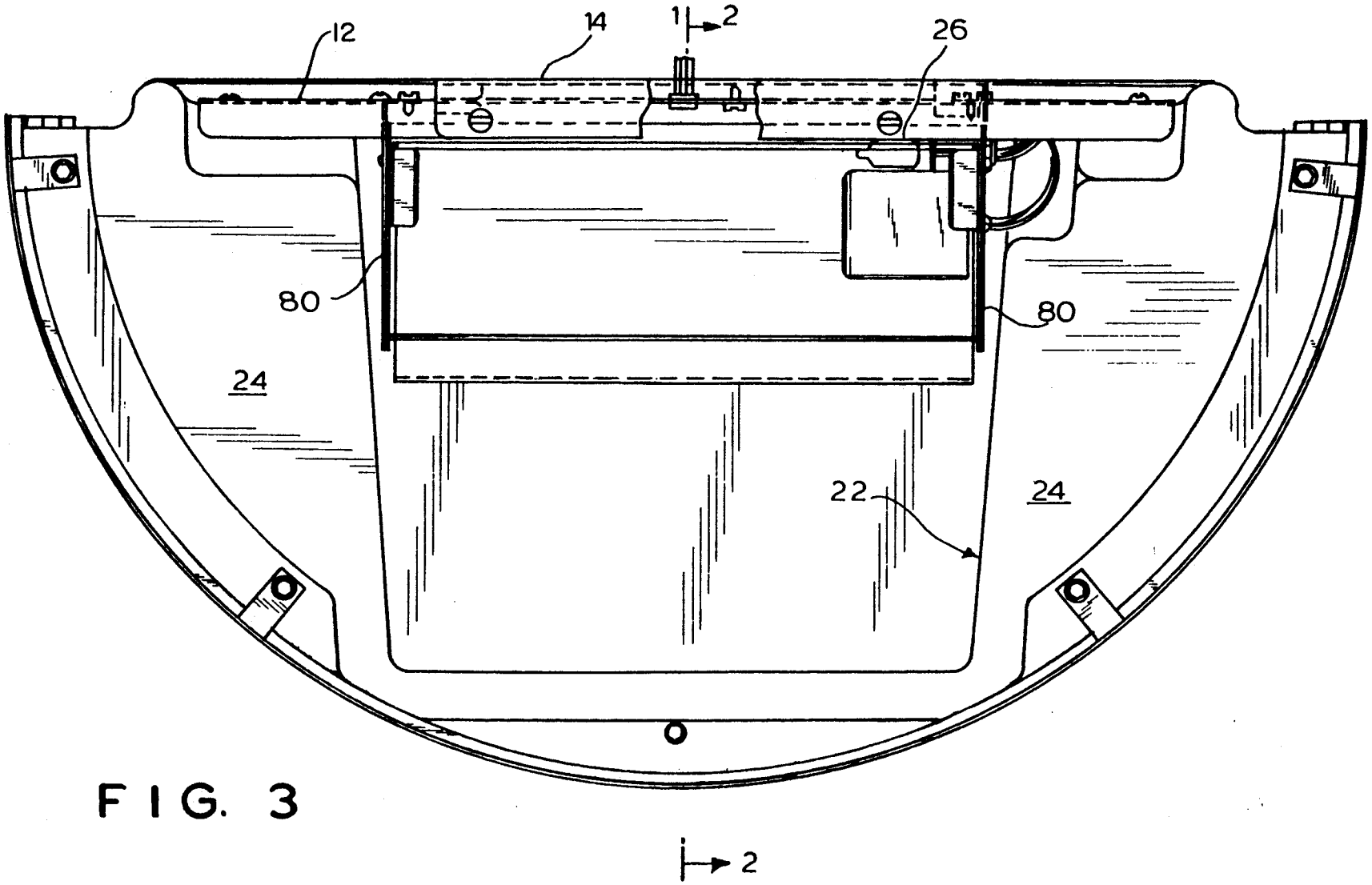
FIG. 3 is a top plan view of the light fixture of FIG. 1.

In an illustrative embodiment of the invention, the bowl 16 is generally one-quarter spherical in shape. The bowl is a hollow member formed of blown polyethylene, or the like, preferably in a translucent white color, although other translucent colors can be used as desired. As seen in FIG. 2, the bowl is a one-piece element which includes a quarter spherical outer surface 18 and an inner surface 20 which defines a recess 22 in the upper face of the bowl. As seen in FIG. 3, the recess 22 is generally rectangular in shape and extends between upper flat surfaces 24 of the upper side of the bowl.

The recess 22, as defined by the surface 20, has a series of inclined surfaces 26, 28, 30. As seen in FIG. 2, the surface 26 extends at an angle of about 28° to the horizontal while the surface 28 extends at an angle of about 38°, and the surface 30 at an angle of 4°. As described hereinafter, these angle surfaces aid in reflecting light internally within bowl 16 to illuminate the exposed quarter spherical surface 18 and produce accent lighting in the fixture.

The wall plate 14 is a generally flat metal member having an upper outwardly turned flange 32 formed thereon. The wall member is adapted to be mounted in a fixed position on a wall in any convenient manner such as, for example, by keyhole arrangements, molybolt connections, or the like, as would be apparent to those skilled in the art. The plate has an opening 34 formed therein to allow electrical service 36 to pass from the outlet box in the wall to the interior of the light fixture.

Bowl 16 is supported on wall plate 14 by a bowl mounting bracket 38. The latter is also a relatively flat metal plate, and it also has an outwardly directed flange 40 which is generally complementary to flange 32. As seen in FIG. 2, flanges 32, 40 are bolted together by bolts 42, or the like, to support the bowl mounting bracket on the wall plate. The bowl mounting bracket is in turn connected to the rear wall 44 of bowl 16 by a plurality of screws 46 which are threadedly engaged in the lock connectors 48 received in bosses 50 formed in the rear wall of the bowl. In this manner, the bowl, which is relatively lightweight, is supported on the wall bracket.

The trim ring 12 is formed of extruded aluminum, or the like, in any desired decorative external configuration. It is semi-circular in plan, as seen in FIG. 3, and it is secured to the upper end portion 50 of the bowl by angle brackets 52 welded or otherwise secured to the trim ring and bolted by screws 54, or the like, directly into the polyethylene bowl along the upper surface 50.

A light reflector assembly 60 is mounted within the recess 22 of the light fixture. The reflector assembly includes a main reflector element 62 which is generally scroll-shaped, as shown more particularly in FIG. 4. The reflector extends longitudinally within the recess 22 along a longitudinal axis generally parallel to wall mounting plate 14. The scroll has a forward lower edge 64 and a rearward upper edge 66 located above the lower edge 64 relative to trim ring 12. The reflector wall extends in a somewhat scroll or nautilus shape from the front lower wall 64 to the upper rear wall 66. The particular dimensions and curvatures of the scroll are noted in FIG. 4, and are selected in order to produce a predetermined light pattern, as described hereinafter.

The lateral ends of the reflector wall have a plurality of bendable tabs 70 formed thereon. These tabs are received in slots formed in the side walls or kickers 72 of the reflector assembly. These side walls have a peripheral shape which is generally complementary to the shape of the scroll and a side edge 74 extending generally between scroll edges 64 and 66. The surfaces of the side walls 72 and the reflector wall 62 may be coated with a white reflector material or it may be formed of specular aluminum or the like.

Reflector assembly 60 is mounted on the bowl mounting bracket by a pair of side plates or pylons 80. These pylons have edge portions 82 complementary to the edge portions 74 of the kickers and extend rearwardly, as seen most clearly in FIG. 2, to laterally extending flanges 84. The latter are bolted by screws 86, or the like, to the bowl mounting plate 14. In this manner the reflector is rigidly supported on the bowl mounting plate and the entire assembly is supported on the wall mounting bracket.

The kickers and pylons of the reflector assembly include appropriate apertures formed therein for supporting a light fixture, such as for example a high intensity halogen lamp 90, or a conventional biax fluorescent lamp 92. Electrical wiring from the supply 36 to the sockets of these light fixtures is provided as appropriate. The light sources 90 or 92 are positioned within the reflector in predetermined locations in order to provide optimum reflection of light therefrom with the configuration of the reflector described above. Preferably, with a high intensity lamp, the lamp is located above the edge 64 of the reflector. In this way some of the light from the bulb passes directly laterally from the bulb to surface 26 of the bowl. The remainder of the light passes directly upwardly or is reflected by the scroll shaped surface of the reflector upwardly and outwardly from the lamp, in order to produce upward indirect lighting. The light passing from the bulb to the bowl is reflected internally within the bowl, as seen in FIG. 2, to provide an entire luminous surface on the bowl even in the areas beneath the reflector which do not receive direct light from the lamp. As a result, both indirect and accent lighting are provided in the wall fixture of the present invention from a single light source.

Because the light fixture is subject to various changes in temperature, bowl 16 is provided with an air vent 100 in its rear surface. This permits air to enter and leave the bowl upon heating and cooling, without affecting the configuration of the bowl. Preferably, vent 100 is plugged with a fibrous vent plug 102, or the like, to prevent dirt from entering into the interior of the bowl.

In order to provide a uniform dispersion of light above the light fixture, it is preferred to use a clear ultra violet light blocking lens 110 which may be formed as a frosted glass plate or the like. The lens 110 is pivotally mounted on the reflector by end brackets 112 which are generally U-shaped in cross-section, and receive the edges of the glass plate. The plate is held in position by set screws 114, or the like. The bight portions 116 of clamps 112 have pivot pins 118 formed therein that are received in complementary pivot holes in the kickers or side walls of the reflector. The plate may rest against the lower edge 64 of the reflector in its lowermost position, or any other convenient stop mechanism for limiting rotation of the diffuser plate may be provided, as it would occur to those skilled in the art.

Although an illustrative embodiment of the invention has been described herein with reference to the accompanying drawings, it is to be understood that this invention is not limited to that precise embodiment and that various changes and modifications may be effected therein by those skilled in the art without departing from the scope or spirit of this invention.

What is claimed is:

1. A wall lighting fixture comprising a support, a hollow generally translucent member of substantially one-half of a bowl shape mounted on said support, said translucent member including means forming an upwardly opening recess therein, a reflector mounted within said recess and having a predetermined light reflective pattern formed therein and means for mounting a source of light within the reflector whereby the predetermined light reflective pattern of the reflector will reflect light upwardly relative to the translucent member and reflect light laterally to at least a portion of the translucent member whereby the translucent member reflects light within it to provide a luminous surface.

2. A wall lighting fixture as defined in claim 1 wherein said reflector is generally scroll-shaped and has a longitudinal axis extending parallel to a wall on which the support is to be mounted.

3. A wall lighting fixture as defined in claim 2 wherein said scroll-shaped reflector opens upwardly.

4. A wall lighting fixture as defined in claim 3 wherein said translucent member has an upper edge and said recess extends below said upper edge; said scroll-shaped reflector having a first forward edge located below the upper edge of the translucent member, a second rear edge located above the forward edge and a scroll-shaped reflective surface extending therebetween.

5. A wall lighting fixture as defined in claim 4 including a light transparent lens pivotally mounted on the reflector above the source of light.

6. A wall lighting fixture as defined in claim 5 wherein said translucent member has an air vent formed therein.

7. A wall lighting fixture as defined in claim 6 wherein said translucent member is formed of blow molded polyethylene.

8. A wall lighting fixture comprising a wall mounting plate; a hollow translucent member of one-half bowl slope having an upper edge portion mounted on said plate, said translucent member having a recess formed therein below said upper edge portion; a light reflective element mounted within the recess of the translucent member, and means for supporting a source of light in a predetermined position relative to said reflector, said reflector extending generally parallel to said wall mounting plate and having a predetermined generally arcuate shape including front and rear edge portions selected to reflect a majority of the light from the light source upwardly above the frame and a portion of the light from the light source laterally above one of the edges thereof and beneath, the upper edge of the translucent member whereby light is received by the translucent member and reflected therein to illuminate the entire translucent member.

9. A wall lighting fixture as defined in claim 8 wherein said reflector is generally scroll-shaped in cross-section with said forward edge thereof being located lower in the recess of the translucent member than the rear edge thereof.

10. A wall lighting fixture as defined in claim 9 wherein said means for supporting a source of light in the reflector is located within the reflector at an elevation which is above the forward edge of the reflector and below the rearward edge thereof.

11. A wall lighting fixture as defined in claim 10 wherein said reflector opens upwardly.

12. A wall lighting fixture as defined in claim 11 including a light transparent lens pivotally mounted on the reflector above the source of light.

13. A wall lighting fixture as defined in claim 12 wherein said translucent member has an air vent formed therein.

14. A wall lighting fixture as defined in claim 13 wherein said translucent member is formed of blow-molded polyethylene.

* * * * *